US009322186B1

(12) United States Patent
Chang et al.

(10) Patent No.: US 9,322,186 B1
(45) Date of Patent: Apr. 26, 2016

(54) LEVELING SPACER SYSTEM FOR PANEL MEMBERS

(71) Applicants: Jason Chang, Taichung (TW); Richard Maggio, Jr., Taichung (TW); Rick Baldini, Taichung (TW)

(72) Inventors: Jason Chang, Taichung (TW); Richard Maggio, Jr., Taichung (TW); Rick Baldini, Taichung (TW)

( * ) Notice: Subject to any disclaimer, the term of this patent is extended or adjusted under 35 U.S.C. 154(b) by 0 days.

(21) Appl. No.: 14/617,956

(22) Filed: Feb. 10, 2015

(51) Int. Cl.

| | |
|---|---|
| ***E04F 13/08*** | (2006.01) |
| ***E04F 21/20*** | (2006.01) |
| ***E04F 21/00*** | (2006.01) |
| *E04F 15/00* | (2006.01) |
| *E04F 21/22* | (2006.01) |

(52) U.S. Cl.
CPC ..... *E04F 21/20* (2013.01); *E04F 21/0092* (2013.01); *E04F 13/08* (2013.01); *E04F 13/0892* (2013.01); *E04F 15/00* (2013.01); *E04F 21/22* (2013.01)

(58) Field of Classification Search
CPC ..... E04F 13/0892; E04F 13/08; E04F 21/22; E04F 13/0889; E04F 15/02; E04F 15/00; E04F 15/02005; E04F 21/0092
USPC ..... 52/126.1, 127.7, 126.4, 389, 392, 52/747.11, DIG. 1
See application file for complete search history.

(56) References Cited

U.S. PATENT DOCUMENTS

| | | | | | |
|---|---|---|---|---|---|
| 3,990,199 | A * | 11/1976 | Gallo | E04H 13/006 | 52/126.4 |
| 4,070,835 | A * | 1/1978 | Reverend | E04F 13/0816 | 52/126.1 |
| 4,768,321 | A * | 9/1988 | Crandell | E04F 13/0808 | 52/235 |
| 4,793,068 | A * | 12/1988 | Golkar | G01B 3/30 | 33/518 |
| 5,269,114 | A * | 12/1993 | Albers | E04G 13/00 | 52/127.7 |
| 5,675,942 | A * | 10/1997 | Crawford | E04F 13/0892 | 52/127.3 |
| 6,796,049 | B1 * | 9/2004 | Claxton | E04F 21/0092 | 33/527 |
| 7,257,926 | B1 * | 8/2007 | Kirby | E04F 15/02005 | 33/526 |
| 7,621,100 | B2 * | 11/2009 | Kufner | E04F 13/0892 | 33/526 |
| 8,099,926 | B2 * | 1/2012 | Kufner | E04F 15/02005 | 33/526 |
| 8,181,420 | B2 * | 5/2012 | Torrents I Comas | E04F 21/0092 | 52/127.7 |
| 8,336,279 | B2 * | 12/2012 | Kufner | E04F 15/02005 | 33/526 |
| 8,635,815 | B2 * | 1/2014 | Bordin | E04F 21/0092 | 33/526 |
| 8,689,521 | B1 * | 4/2014 | Hoffman | E04F 13/0889 | 52/747.11 |
| 8,689,522 | B2 * | 4/2014 | Hoffman | E04F 21/00 | 52/747.11 |
| 9,045,911 | B2 * | 6/2015 | Hoffman | E04F 21/0092 | |
| 9,097,026 | B2 * | 8/2015 | Hoffman | E04F 21/22 | |
| 9,228,363 | B2 * | 1/2016 | Kufner | E04F 21/20 | |
| 2004/0060184 | A1 * | 4/2004 | Shilo | E04F 21/0092 | 33/526 |
| 2015/0211243 | A1 * | 7/2015 | Irvine | E04F 21/0092 | 52/126.1 |

* cited by examiner

*Primary Examiner* — Phi A

(57) ABSTRACT

A leveling spacer system includes a multiple plates, multiple spacers and multiple knobs. The spacers are threadedly connected to the knobs to clamp the panel members, and the plates are used to connect the spacers and the knobs together with so as to clamp more panel members. The plates and the knobs are located on the top of the panel members, and the spacers are located at the underside of the panel members. When the panel members are leveled, the knobs are removed, and the necks on the spacers are broken to finish the leveling of the panel members.

8 Claims, 13 Drawing Sheets

LEVELING SPACER SYSTEM FOR PANEL MEMBERS

BACKGROUND OF THE INVENTION

1. Fields of the Invention

The present invention relates to a spacer system, and more particularly, to a leveling spacer system for adjusting the leveling of the panel members.

2. Descriptions of Related Art

The conventional spacer is disclosed in U.S. Pat. No. 8,635,815 and comprises a spacer and a knob, wherein the spacer has a base with multiple protrusions extending therefrom. A first threaded portion extends from the base and a cross connection portion is connected to the stem. Multiple breakable portions are located between the connection portion and the protrusions. The knob has a second threaded portion which is connected to the first threaded portion. The knob has a flat portion at the underside thereof so as to press on the tiles. The knob has a space defined therein. However, the knob and the spacer can only adjust two or four panel members at one time, in other words, when there are many panel members to be adjusted, it takes time. Besides, the gaps between the panel members can only be adjusted within a limited range. The spacer involves a complicated shape so that the molding expenses are high.

Another conventional spacer is disclosed in U.S. Pat. No. 4,397,125 and comprises a pressure member, a clip, a wing nut and a bolt, wherein the pressure member has an elongate notch. The clip is located beneath the tiles and the clip has a fixed end which has a tapered resilient flange which contacts the tiles. The clip has a U-shaped spacing loop which is located corresponding to the notch. The spacing loop has an aperture which is located corresponding to the wing nut. The bolt is threadedly connected to the wing nut, and the bolt is securely connected to the aperture. However, again, the spacer can only adjust two or four panel members at one time, in other words, when there are many panel members to be adjusted, it takes time. Besides, the pressure member, the clip, the wing nut and the bolt are individual parts so that when operating these parts, it takes time.

The present invention intends to provide a leveling spacer to eliminate the shortcomings mentioned above.

SUMMARY OF THE INVENTION

The present invention relates to a leveling spacer system and comprises a plurality of spacers and each spacer has a base 21 which is a circular base with a flat underside. The base contacts the undersides of panel members. Each base has a rectangular neck extending therefrom. Each neck has a thickness so as to define a gap between panel members. A groove is defined transversely in each of the two opposite faces of each neck and the grooves is located in alignment with the top of the panel members. Each neck has a first threaded potion connected to the top thereof.

A plurality of rectangular plates each are located on the panel members. The longitudinal length of each plate is longer than two times of the side of each panel member. Each plate has at least two notches. Each notch has one of the necks extends therethrough. The width of each notch is larger than or equal to the width of the neck. The distance between two adjacent notches is equal to a combination width of the width of the panel member and the width of the gap.

A plurality of knobs are respectively connected to the spacers. Each knob has a pressing portion which has a flat underside. A tubular portion extends from the top of the pressing portion. The tubular portion has a second threaded portion defined therein. The first threaded portion is threadedly connected to the second threaded portion to press the pressing portion onto the plate which presses on the panel members. Each tubular portion has two wings extending therefrom. Each of the pressing portions has a space defined therein.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
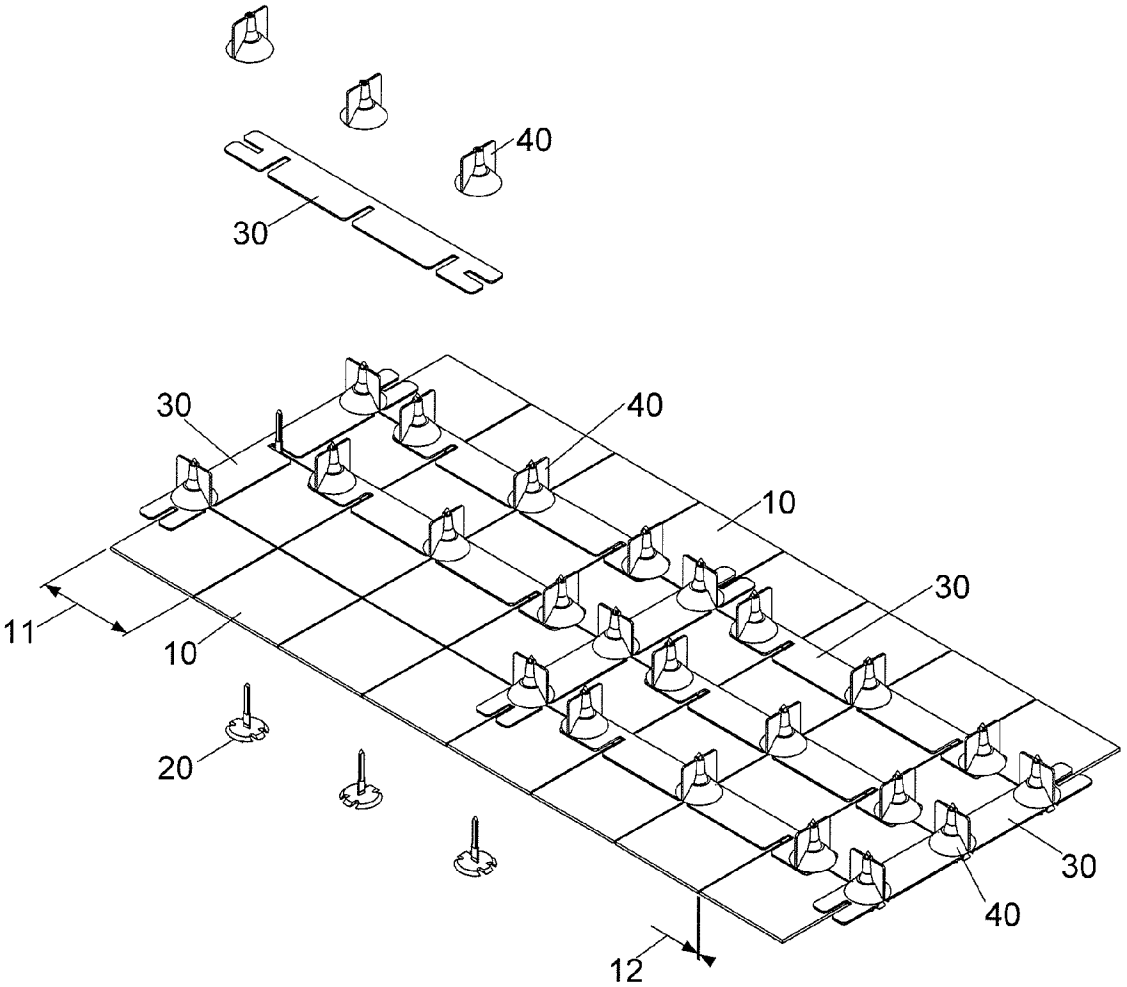
FIG. 1 is an exploded view of the leveling spacer system of the present invention.
Figure 4:
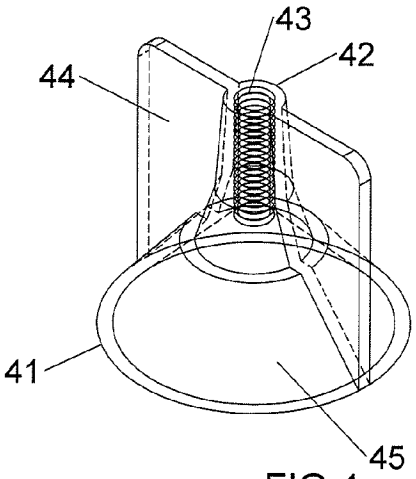
FIG. 4 is a perspective view to show the knob of the leveling spacer system of the present invention.
Figure 2:
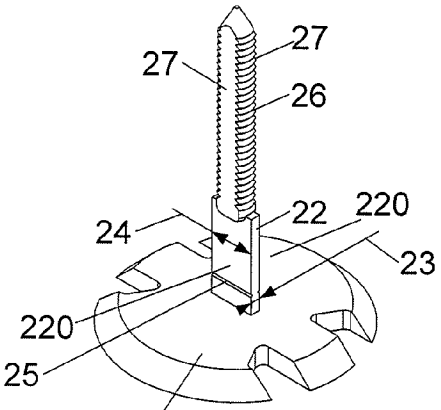
FIG. 2 is a perspective view to show the spacer of the leveling spacer system of the present invention.
Figure 3:
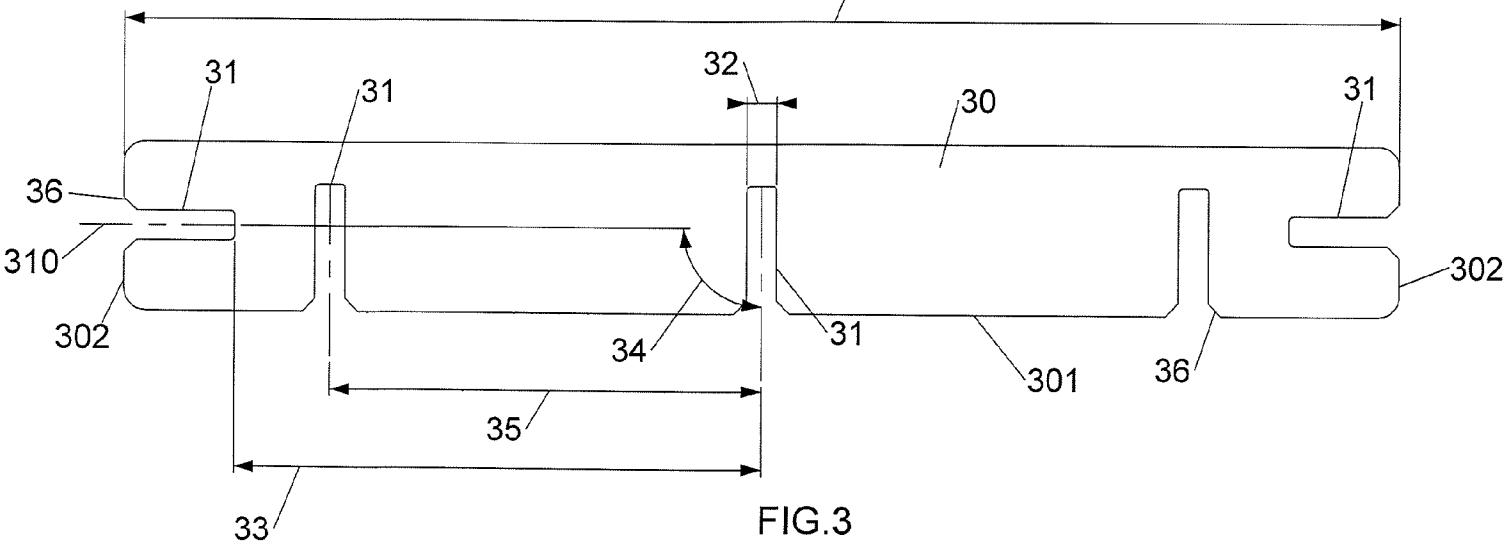
FIG. 3 is a top view to show the plate of the leveling spacer system of the present invention.
Figure 5:
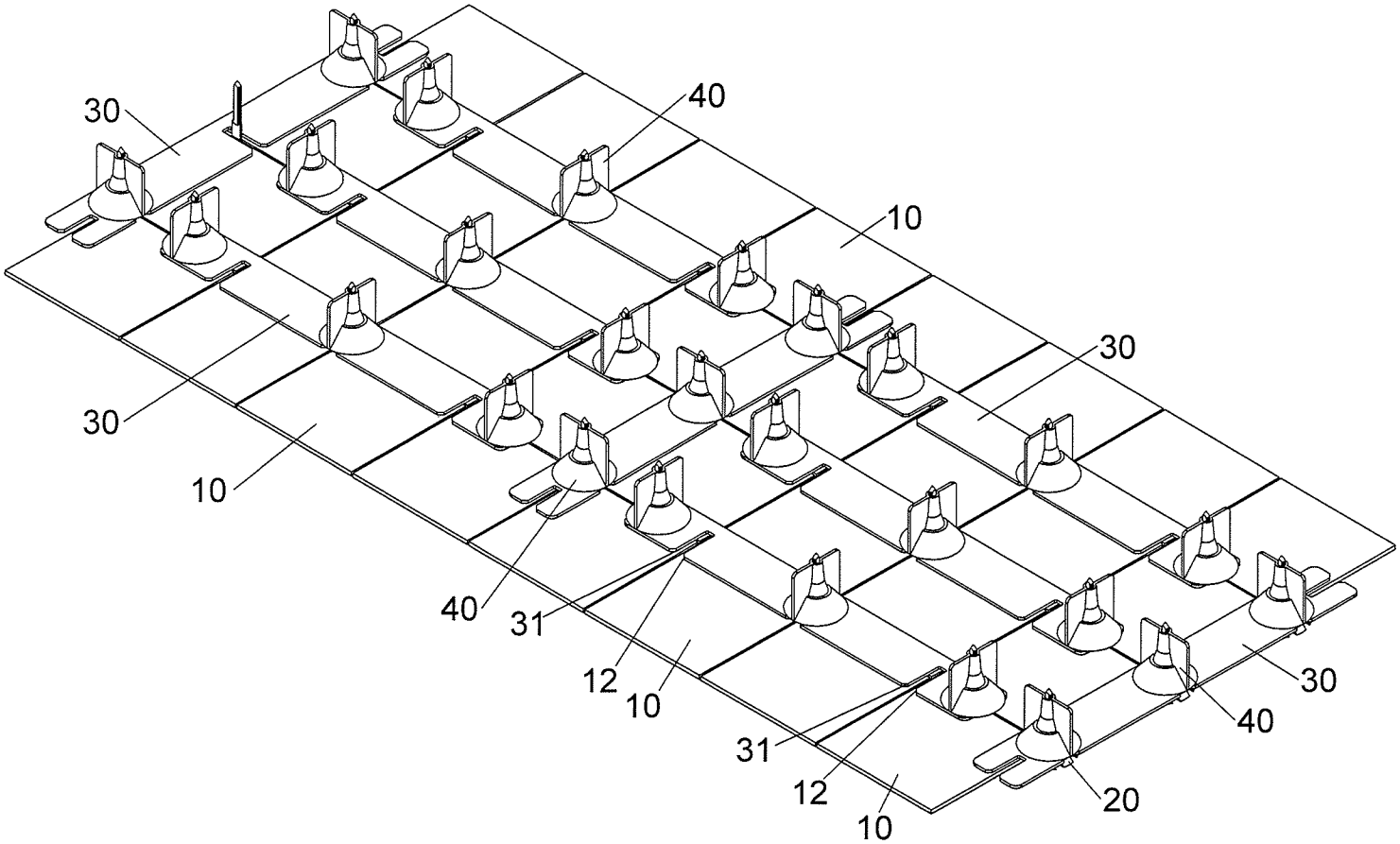
FIG. 5 is a perspective view to show that the leveling spacer system of the present invention is used to level the panel members.

Referring to FIGS. 1 to 6, the leveling spacer system for leveling panel members 10 (such as laying wall tiles, paving tiles or the like) of the present invention comprises a plurality of spacers 20, a plurality of rectangular plates 30 and a plurality of knobs 40. The panel members 10 each have four sides 11, and there is a gap 12 defied between two adjacent panel members 10.

Each spacer 20 has a base 21 which is a circular base with a flat underside. The base 21 contacts the undersides of the panel members 10. Each base 21 has a rectangular neck 22 extending therefrom, and each neck 22 has a thickness 23 so as to define the gap 12 between panel members 10. A groove 25 is defined transversely in each of two opposite faces 220 of each neck 22 and the grooves 25 are located in alignment with the top of the panel members 10. The shortest distance from the inner end of the groove 25 to the base 21 is equal to the thickness of the panel member 10. Each neck 22 has a first threaded potion 26 connected to the top thereof. Each of the first threaded portions 26 has two flat surfaces 27 defined in two opposite sides thereof. The two flat surfaces 27 are parallel to the faces 220 of each of the necks 22. The longitudinal length 300 of each plate 30 is longer than 2 to 2.5 times of the length of the side 11 of each of the panel members 10.

Each of the plates 30 is located on the panel members 10 and has multiple notches 31, each notch 31 has one of the necks 22 extending therethrough. The width 32 of each notch 31 is larger than or equal to the width 24 of the neck 22. Each notch 31 is located corresponding to the gap 12 between the panel members 10. The distance between two adjacent notches 31 is equal to a combination width of the width of the panel member 10 and the width of the gap 12. There are three notches 31 extending transversely from one long side 301 of the plate 30, and two notches 31 extend longitudinally one short side 302 of the plate 30. One of the three notches 31 that extend transversely is located at the center of the plate 30. The other two notches 31 that extend transversely are located symmetrically to the notch 31 that extend transversely and is located at the center of the plate 30. The distance from the inner end 311 of one of the two notches 31 that extend longitudinally to the center of the plate 30 is longer than a combination distance of the side 11 of the panel member 10 and the width of the gap 12. The axis of the each of the notches 31 extending transversely is perpendicular to the axis of each of the two notches 31 extending longitudinally. The distance 35 between the two transversely extending notches 31 that are located next to each other is equal to the combination distance of the side 11 and the width of the gap 12. Each notch 31 has a tapered corner 36 at each of two sides of the opening 310 thereof, such that the opening 310 is a divergent opening.

The number of the knobs 40 is the same as that of the spacers 20. The knobs 40 are located on the plate 30 and are respectively connected to the spacers 20. Each knob 40 has a pressing portion 41 which has a flat underside. A tubular portion 42 extends from the top of the pressing portion 41. The tubular portion 42 has a second threaded portion 43 defined therein. The first threaded portion 26 is threadedly connected to the second threaded portion 43 to press the pressing portion 41 onto the plate 30 which presses on the panel members 10. Each tubular portion 42 has two wings 44 extending therefrom so that the users can rotate the knob 40 by rotating the two wings 44. Each of the pressing portions 41 has a space 45 defined therein.

The panel members 10 are arranged as a matrix arrangement, the bases 21 are located at the underside of the panel members 10, the necks 22 extend through the gaps 12 between the panel members 10. The plates 30 are put on the top of the panel members 10 and the notches 31 are located corresponding to the gaps 12. The necks 22 extend through the notches 31. The knobs 40 are located on the panels 30 and threadedly connected to the spaces 20 by the connection of the first and second threaded portions 26, 43.

Figure 6:
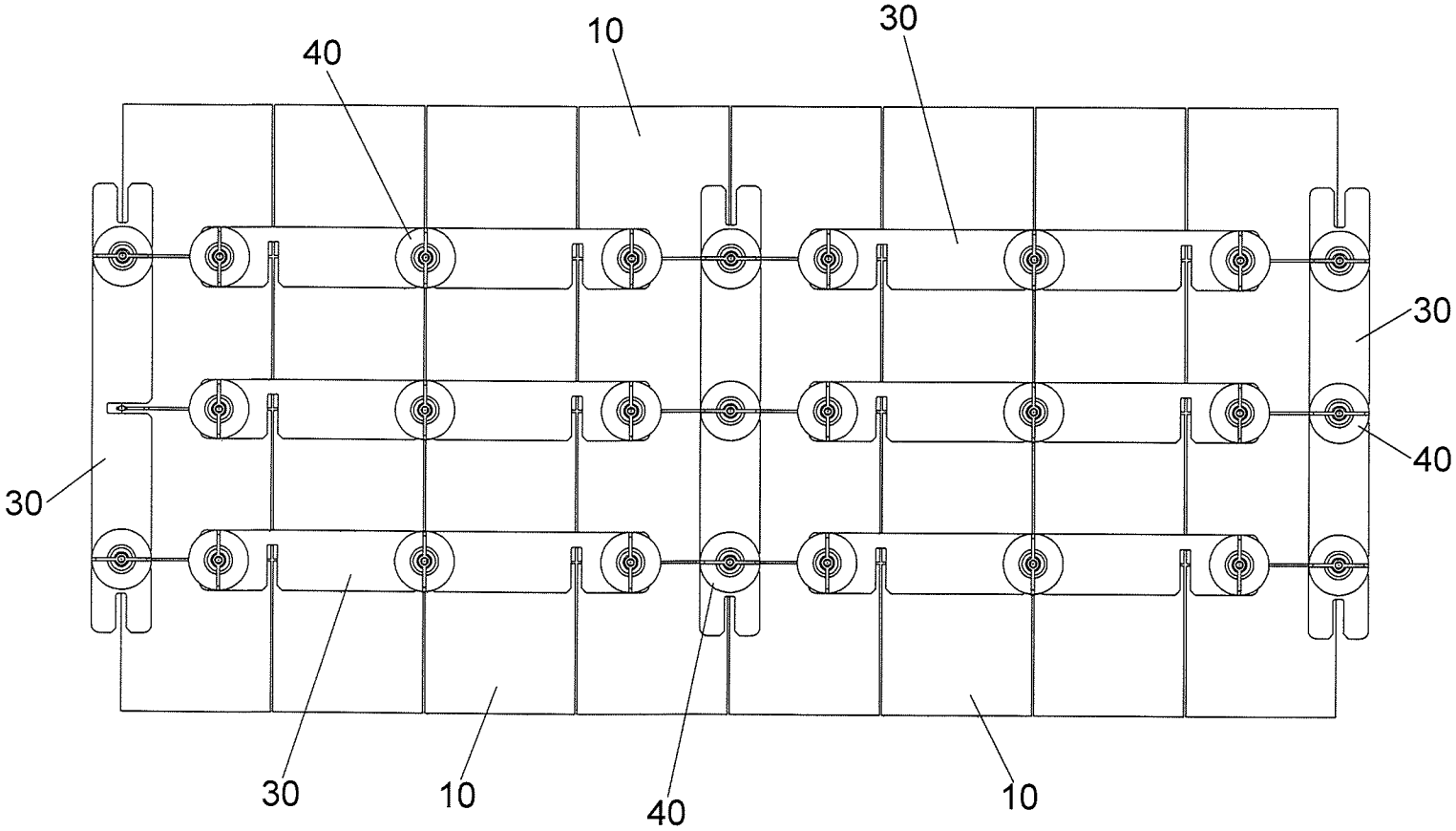
FIG. 6 is a top view of the disclosure in FIG. 5.

In one embodiment, as shown in FIG. 6, eight panel members 10 are connected by multiple plates 30 and each notch 31 of the plates 30 is located corresponding to one gap 12 of two adjacent panel members 10. The knobs 40 are threadedly connected to the spacers 20. The eight panel members 10 are adjusted to be level by the spacers 20, the plates 30 and the knobs 40. When the adjustment of the panel members 10 is finished, the grooves 25 are located in alignment with the panel members 10. The users than remove the knobs 40 from the spacers 20, and the plates 30 are removed. The necks 22 are then broken from the grooves 25, and the panel members 10 are all in alignment with each other.

Figure 7:
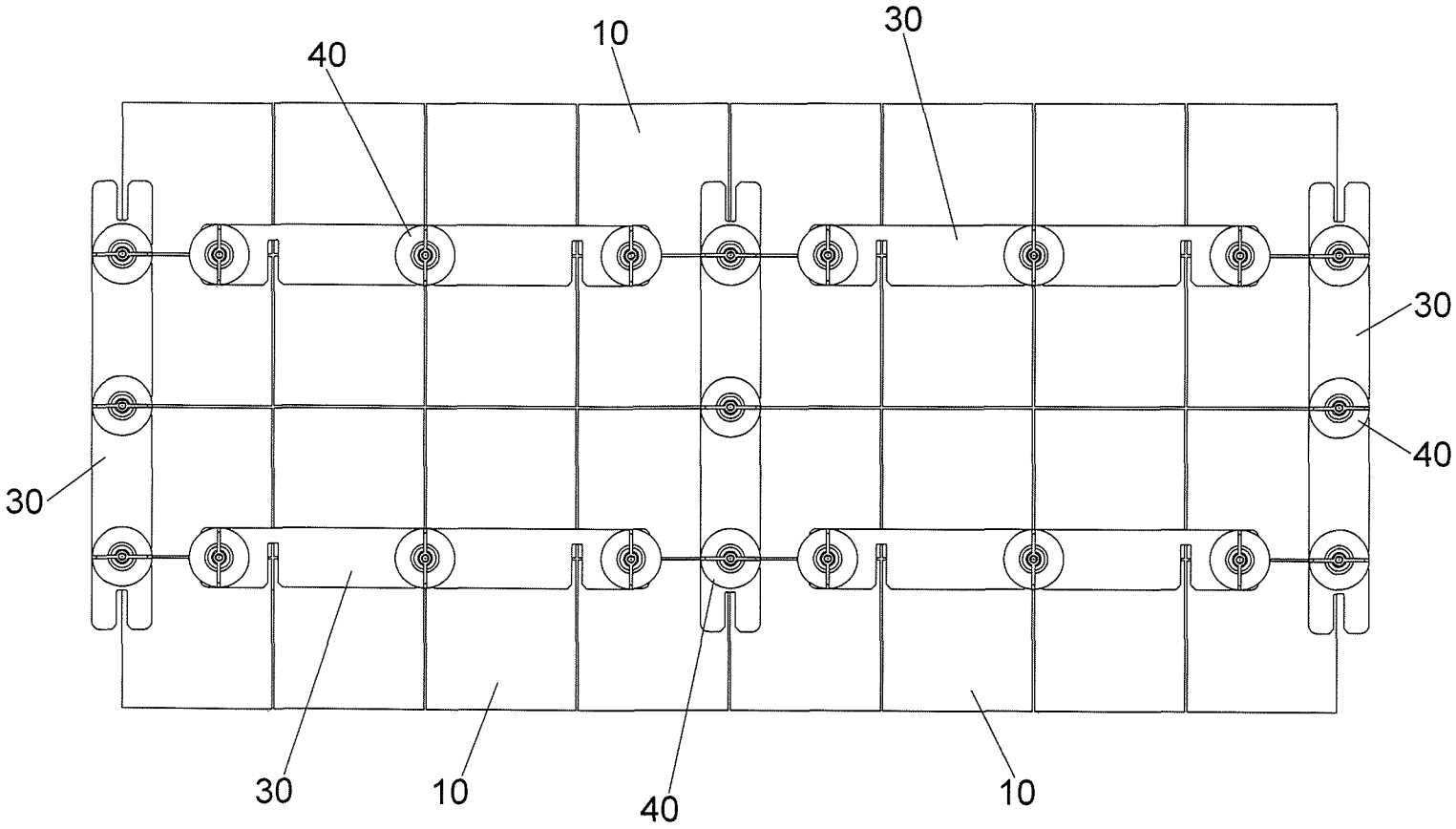
FIG. 7 is a top view to show the second way of use of the leveling spacer system of the present invention.

As shown in FIG. 7, the panel members 10 are adjusted by using three transversely arranged plates 30 and four longitudinally arranged plates 30. Each plate 30 is connected to eight panel members 10.

Figure 8:
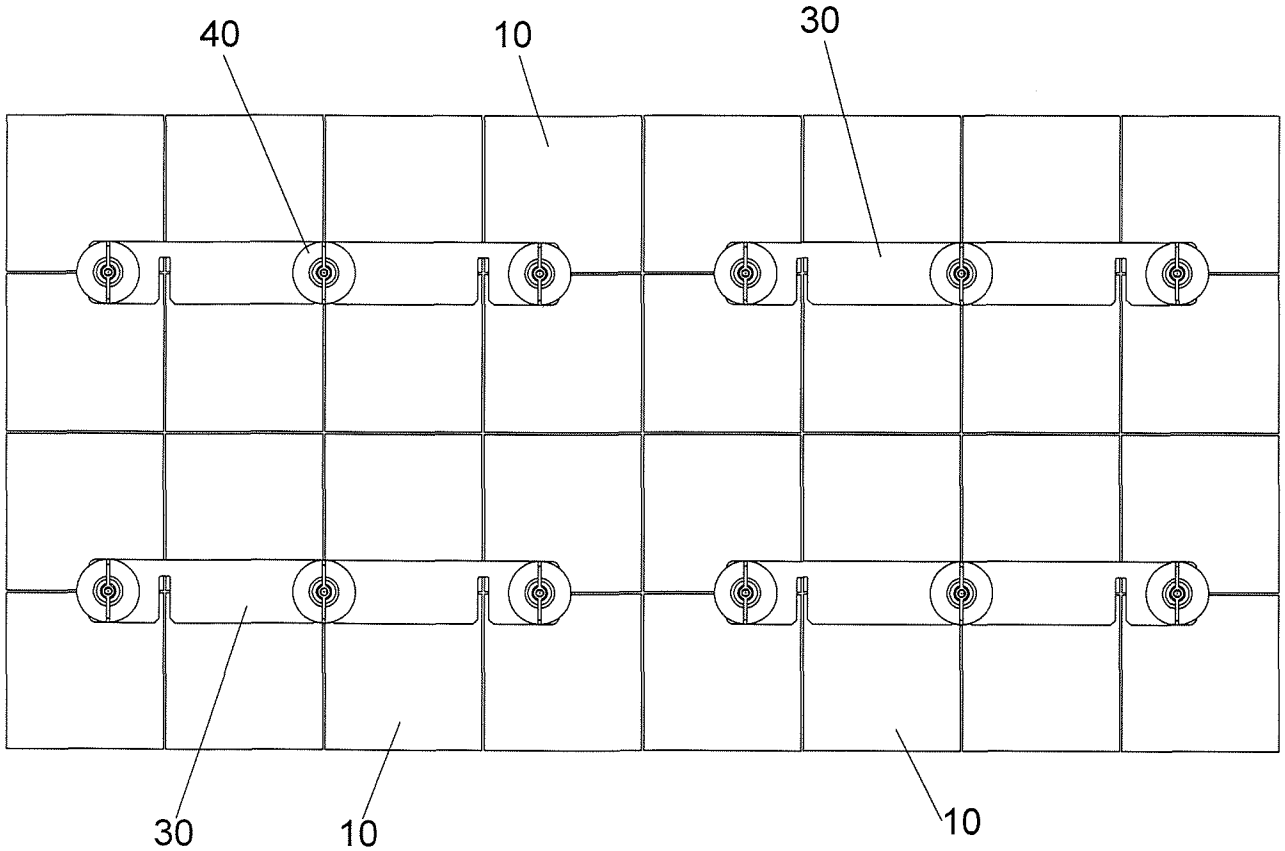
FIG. 8 is a top view to show the third way of use of the leveling spacer system of the present invention.

As shown in FIG. 8, the panel members 10 are adjusted by using four longitudinally arranged plates 30. Each plate 30 is cooperated with three spacers 20 and three knobs 40 to connect eight panel members 10.

Figure 9:
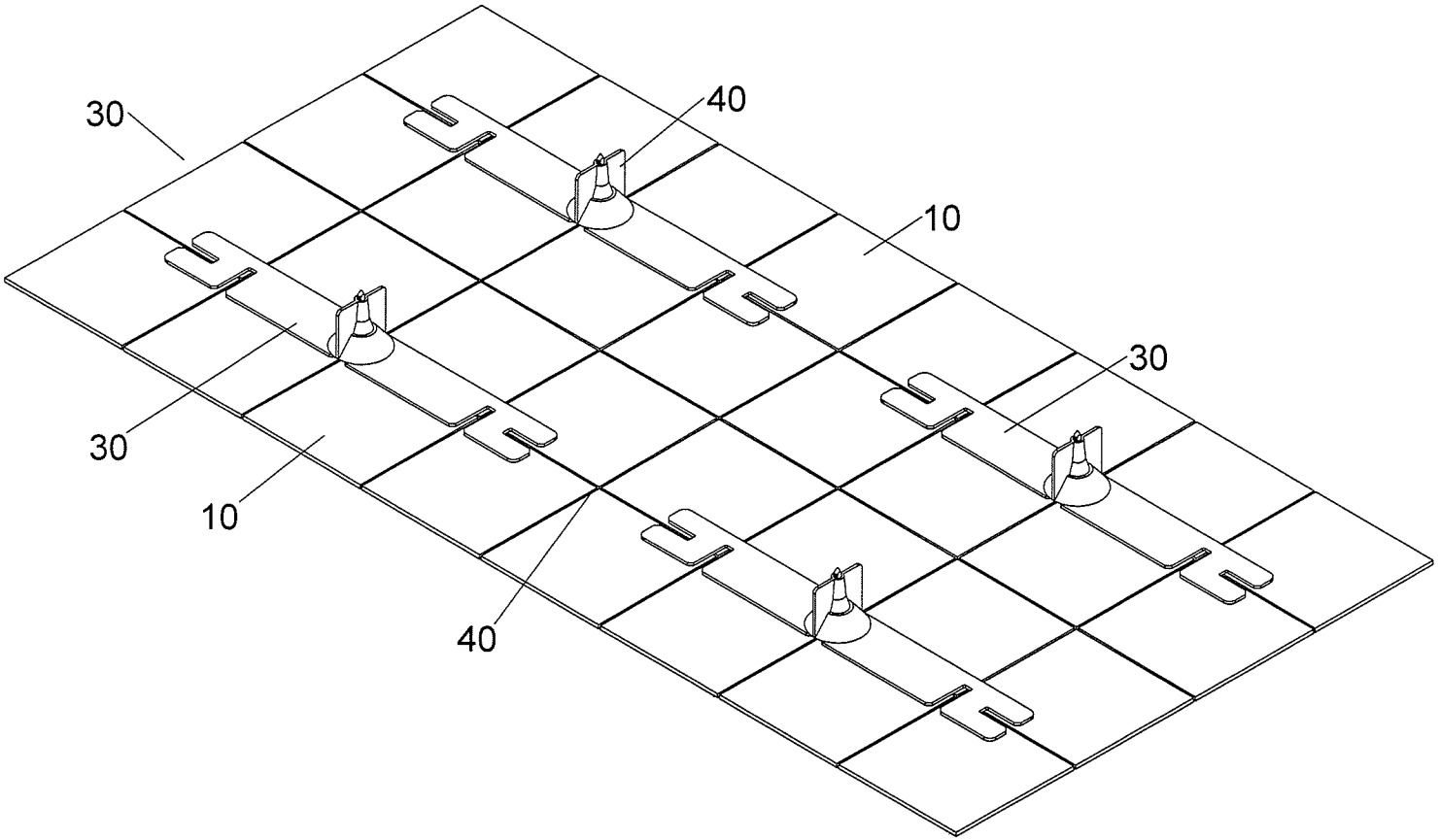
FIG. 9 is a perspective view to show the fourth way of use of the leveling spacer system of the present invention.

As shown in FIG. 9, the panel members 10 are adjusted by using four longitudinally arranged plates 30. Each plate 30 is cooperated with one spacer 20 and one knob 40.

Figure 10:
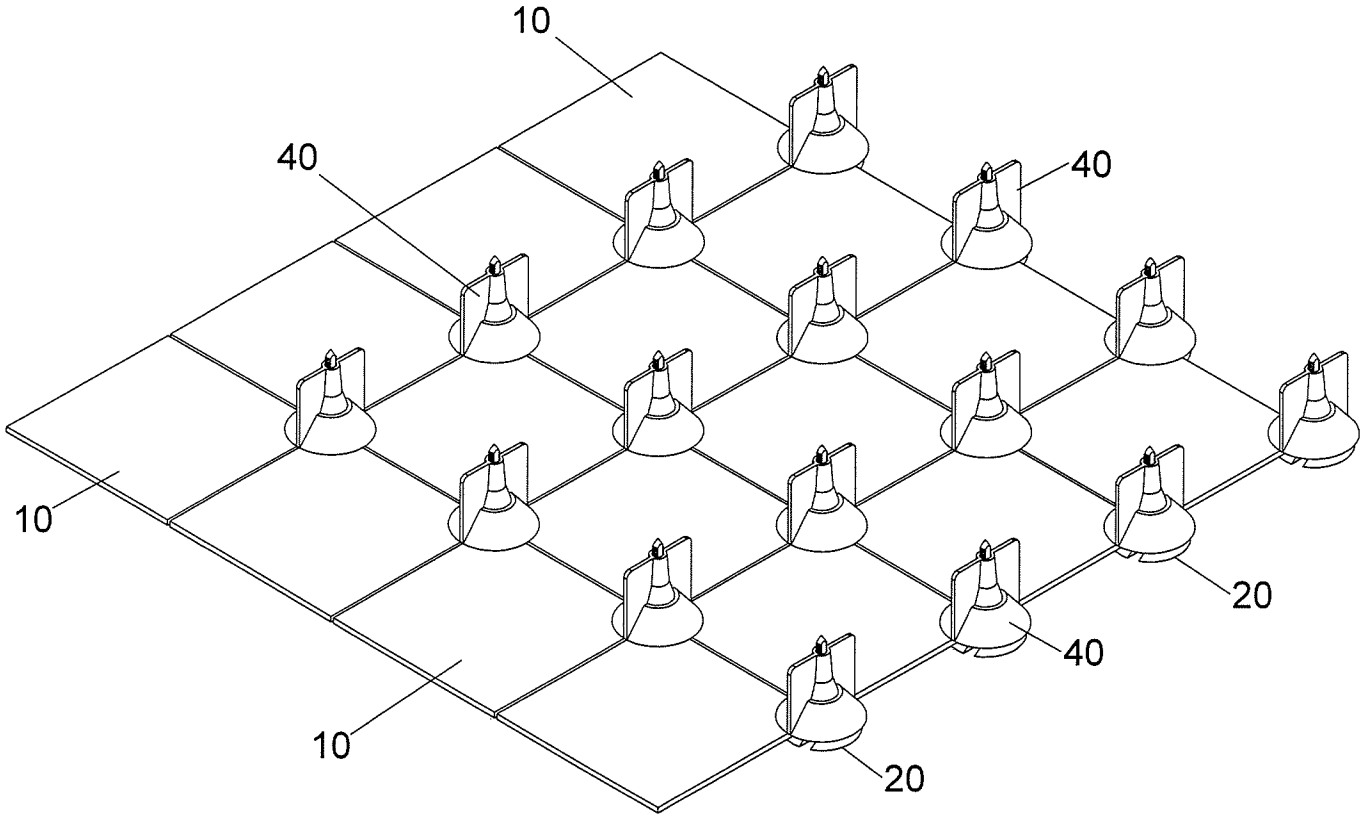
FIG. 10 is a perspective view to show the fifth way of use of the leveling spacer system of the present invention.

As shown in FIG. 10, only spacers 20 and one knobs 40 are used to adjust the panel members 10.

Figure 11:
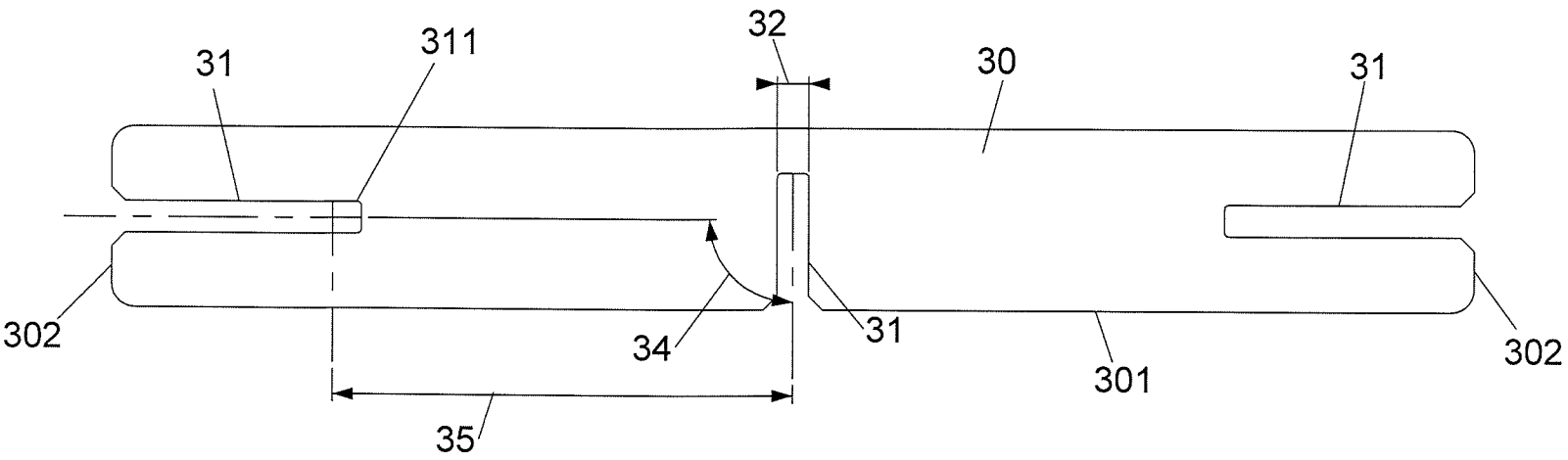
FIG. 11 shows the second embedment of the plate of the leveling spacer system of the present invention.

As shown in FIG. 11, the plate 30 has one notch 31 at the long side 301, and each of the two short sides 302 has one notch 31. The distance from the inner end 311 of the notch 31 of the short side 301 to the center of the plate 30 is shorter than the side 11 of the panel member 10.

Figure 12:
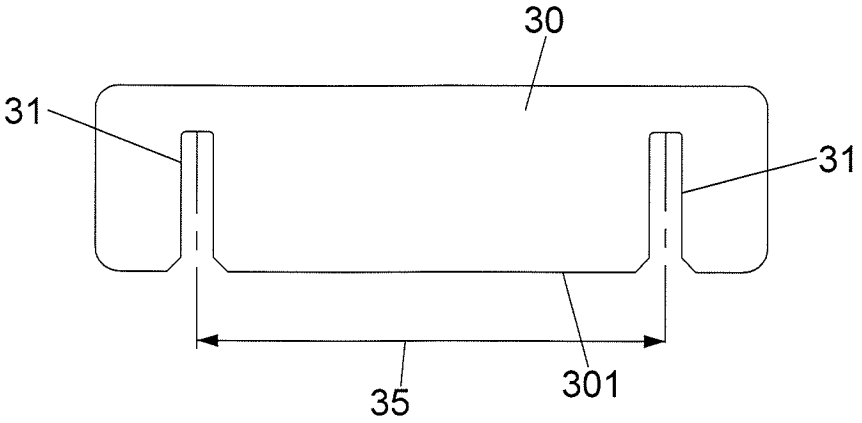
FIG. 12 shows the third embedment of the plate of the leveling spacer system of the present invention.
Figure 13:
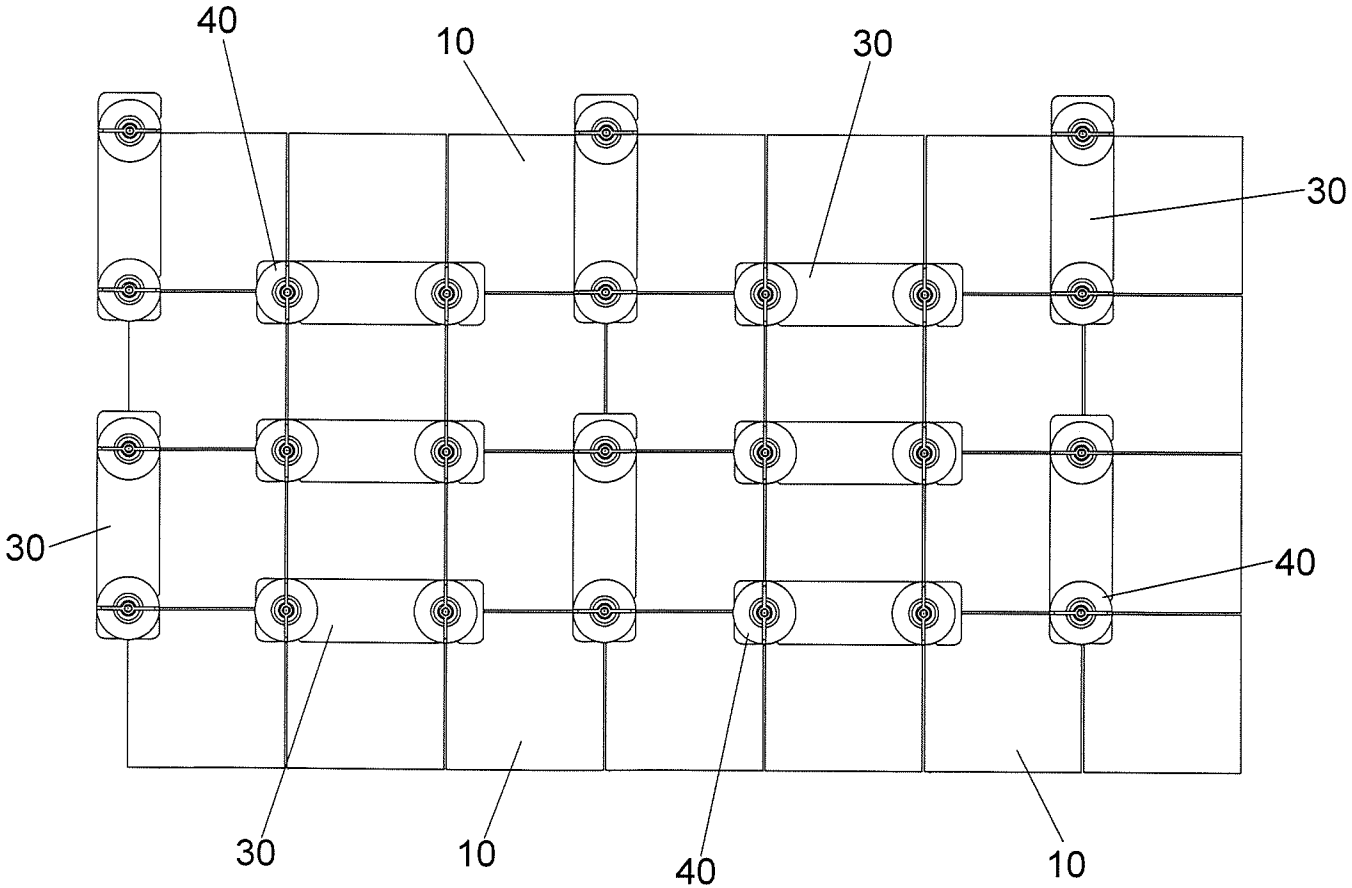
FIG. 13 is a top view of the disclosure in FIG. 12.

FIGS. 12 and 13 show that there are two notches 31 defined in the long side 301 of the plate 30, and the plate 30 is connected to six panel members 10.

Figure 14:
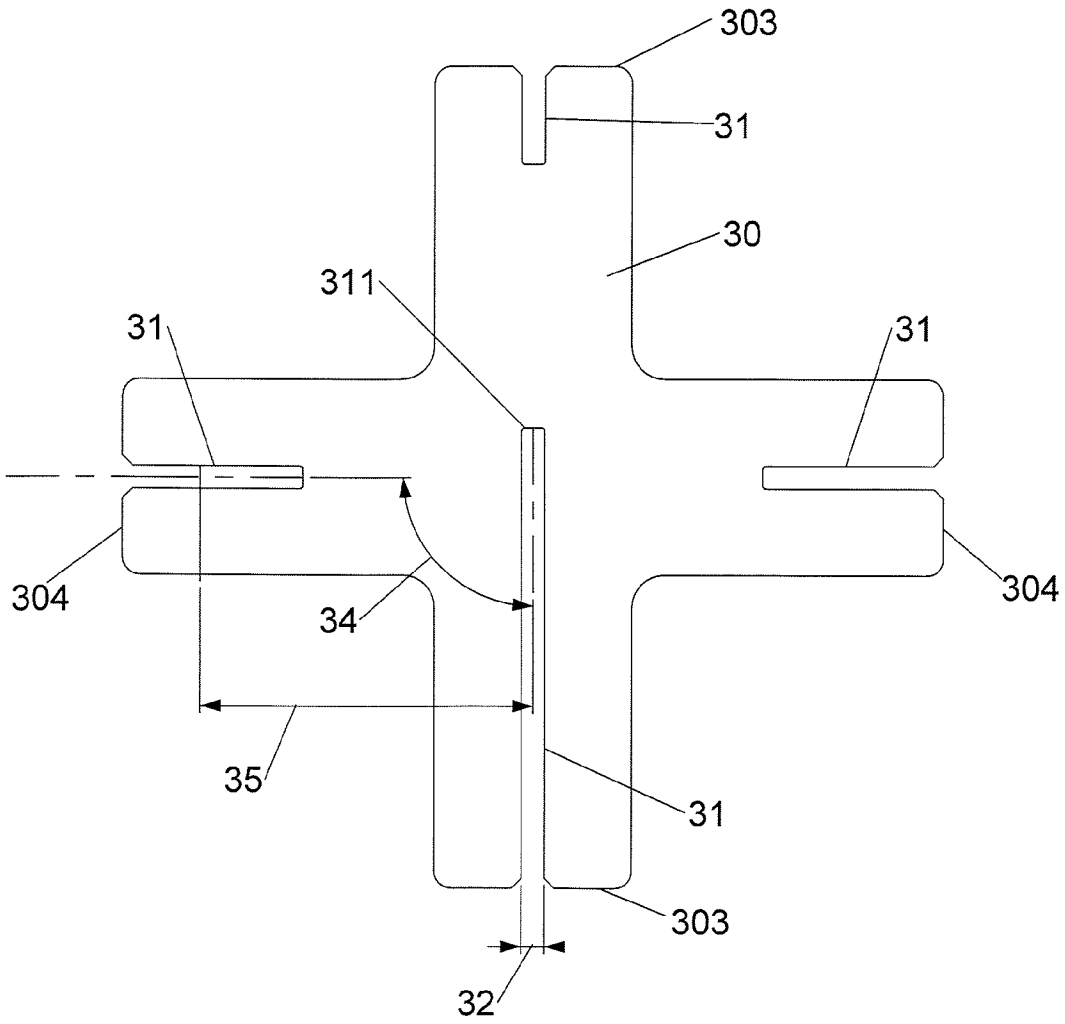
FIG. 14 is a top of the fourth embodiment of the plate of the leveling spacer system of the present invention.
Figure 15:
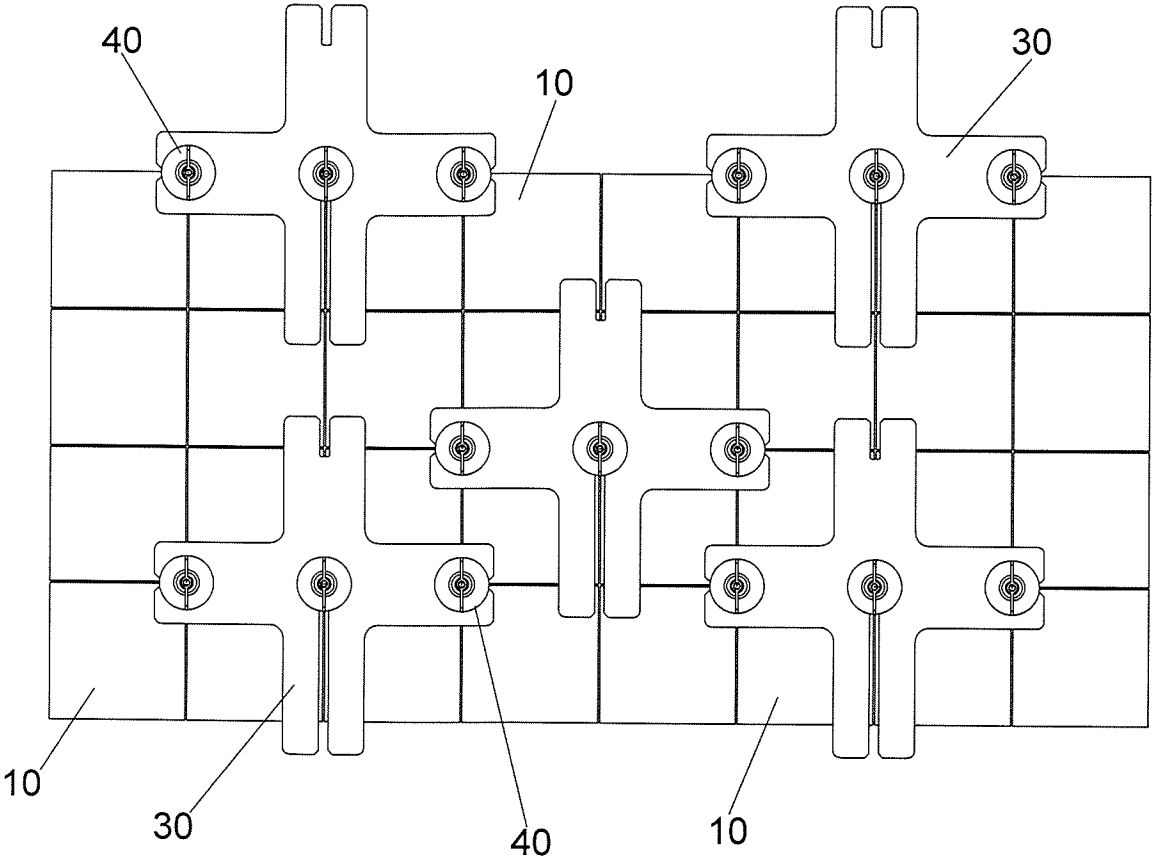
FIG. 15 is a top of the fifth embodiment of the plate of the leveling spacer system of the present invention.

FIGS. 14 and 15 show that the plate 30 is a cross-shaped plate with four distal ends 303, 304. Each of the four distal ends 303, 304 has a notch 31 extending longitudinally. One of the notches 31 in the distal end 303 is extended beyond the center of the plate 30. The length of the notch 31 that extends beyond the center is longer than the combination length of one side 11 of the panel member 10 and the width of the gap 12.

The length 300 is longer than the sum of the side 11 and the width of the gap 12, so that the plate 30 can be used to adjust more panel members 10. The number of the spacers 20, the plates 30 and the knobs 40 are flexibly adjusted according to the practical need. The number of the notches 31 and the shape of the plates 30 can be varied. The knob 40 has a pressing portion 41, the tubular portion 42, the wings 44 and the space 45, so that the material for the knob 40 can be saved. The plates 30 can be cooperated with limited number of the spacers 20 to adjust multiple panel members 10 so as to reduce the consumption of the spacers 20. When all the panel members 10 are adjusted, the users than remove the knobs 40 from the spacers 20, and the plates 30 are removed. The necks 22 are then broken from the grooves 25. The steps are easy and convenient.

While we have shown and described the embodiment in accordance with the present invention, it should be clear to those skilled in the art that further embodiments may be made without departing from the scope of the present invention.

What is claimed is:

1. A leveling spacer system comprising:

a plurality of spacers and each spacer having a base which is a circular base with a flat underside, the base contacting an undersides of panel members, each base having a rectangular neck extending therefrom, each neck having a thickness so as to define a gap between panel members, a groove defined transversely in each of two opposite faces of each neck and the grooves located in alignment with a top of the panel members, each neck having a first threaded potion connected to a top thereof;

a plurality of rectangular plates each located on the panel members, a longitudinal length of each plate being longer than two times of a side of each panel member, each plate having at least two notches, each notch having one of the necks extending therethrough, a width of each notch being larger than or equal to a width of the neck, a distance between two adjacent notches being equal to a combination width of a width of the panel member and a width of the gap, and a plurality of knobs respectively connected to the spacers, each knob having a pressing portion which has a flat underside, a tubular portion extending from a top of the pressing portion, the tubular portion having a second threaded portion defined therein, the first threaded portion being threadedly connected to the second threaded portion to press the pressing portion onto the plate which presses on the panel members, each tubular portion having two wings extending therefrom, each of the pressing portions having a space defined therein.

2. The system as claimed in claim 1, wherein each of the first threaded portions has two flat surfaces defined in two opposite sides thereof, the two flat surfaces are parallel to the faces of each of the necks.

3. The system as claimed in claim 1, wherein the longitudinal length of each plate is longer than 2.5 times of a width of each of the panel members.

4. The system as claimed in claim 1, wherein the at least two notches are five notches which comprises three notches extending transversely and two notches extending longitudinally, one of the three notches that extend transversely is located at a center of the plate, the other two notches that extend transversely are located symmetrically to the notch that extend transversely and is located at the center of the plate.

5. The system as claimed in claim 1, wherein one of the at least two notches has a tapered corner at each of two sides of an opening thereof.

6. The system as claimed in claim 1, wherein the at least two notches are three notches.

7. The system as claimed in claim 1, wherein the at least two notches comprises at least one notch extending transversely and two notches extending longitudinally, a distance from an inner end of one of the two notches that extend longitudinally to a center of the plate is longer than a combination distance of a width of the panel member and a width of the gap, an axis of the at least one notch extending transversely is perpendicular to an axis of each of the two notches extending longitudinally.

8. The system as claimed in claim 1, wherein each of the plates is a cross-shaped plate with four distal ends, each of the four distal ends has a notch extending longitudinally, a length of one of the notches is longer than a combination length of one side of the panel member and the width of the gap.

* * * * *